US005195335A

United States Patent [19]

Hart

[11] Patent Number: 5,195,335

[45] Date of Patent: Mar. 23, 1993

[54] MAGNETIZED NOVELTY BEADS

[76] Inventor: James L. Hart, P.O. Box 205, Embro, Ontario, Canada, N0J 1J0

[21] Appl. No.: 851,296

[22] Filed: Mar. 11, 1992

[51] Int. Cl.[5] ..... A44C 25/00

[52] U.S. Cl. ..... 63/2; 63/1.1

[58] Field of Search ..... 63/2, 1.1, 3; 24/115 H, 24/303

[56] References Cited

U.S. PATENT DOCUMENTS

| | | | |
|---|---|---|---|
| 1,371,932 | 3/1921 | Przybyla | 24/115 H |
| 1,380,827 | 6/1921 | Mullins | 63/2 |
| 1,626,334 | 4/1927 | Falk | 24/115 H |
| 2,521,589 | 9/1950 | Livingston | 63/2 |
| 3,041,697 | 7/1962 | Budreck | 24/303 |
| 3,481,155 | 12/1969 | Cook | 63/2 |
| 4,231,137 | 11/1980 | Fujimoto | 24/303 |
| 4,622,726 | 11/1986 | Nakamura | 24/303 |
| 4,909,298 | 3/1990 | Langhart et al. | 24/303 |
| 5,008,984 | 4/1991 | Levy | 24/303 |
| 5,050,276 | 9/1991 | Pemberton | 24/303 |

FOREIGN PATENT DOCUMENTS

| | | | |
|---|---|---|---|
| 3841903 | 6/1990 | Fed. Rep. of Germany | 63/2 |
| 1443118 | 5/1966 | France | 63/2 |
| 2254289 | 6/1975 | France | 63/2 |
| 16468 | of 1887 | United Kingdom | 63/2 |

*Primary Examiner*—Renee S. Luebke
*Assistant Examiner*—Michael Milano

[57] ABSTRACT

A necklace is provided on a flexible string that passes through a plurality of bead-like members, some of the beads on the string being magnetized so that when two of such beads are placed in the juxtaposed position, the necklace assumes a unique shape.

5 Claims, 1 Drawing Sheet

MAGNETIZED NOVELTY BEADS

BACKGROUND OF THE INVENTION

This invention relates to a necklace or the like comprised of discreet beads which have selectively positioned magnetized pieces whereby to create adjustably novel configurations.

THE INVENTION

The invention therefore contemplates and achieves an endless flexible loop composed of a plurality of discreet elements carried by the continuous loop, most elements being of non-magnetized material and at least two elements spacially disposed at a pre-determined distance from each other being magnetized whereby, when the magnetized elements are juxtaposed, they constrain the necklace in a unique predetermined configuration. The elements, whether magnetizable nor not, may be pigmented to various colours and various shapes, for instance, hexahedron, spherical or cylindrical.

BRIEF DESCRIPTION OF THE DRAWINGS

The invention will now be described by way of example and in reference to the drawings in which.

DESCRIPTION OF THE PREFERRED EMBODIMENT

Figure 4:
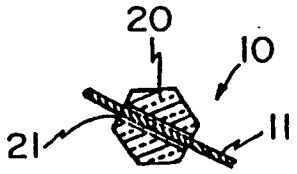
FIG. 4 illustrates the elements of the necklace in partial assembly view.

Referring to FIG. 4, the necklace 10 consists of a longitudinal flexible string or strand 11, a plurality of beads 20 having an aperture 21 therethrough, through which the string may pass so that the beads 20 may be placed in a juxtaposed position, as more clearly seen in the figures. At periodical intervals along the strand 11, say when 28 or 30 of such beads 20 are juxtaposed together, then a powdered iron magnetized element 40 is threaded onto the strand 11 and then a further number of beads, say 15 in number may be threaded onto the strand 11 and then, a second magnetizable member 41 is threaded thereon. If this is done from both ends of the strand 11, then an additional sixty beads 20 may be threaded on and that results in larger loop L being created when the ends of the string are tied with a knot or bow at location 40, not clearly seen in the drawing. There are thus, in the aforesaid, 28 beads between elements 41, see FIG. 2, 15 bead elements between each parallel run R in FIG. 2, and of course the smaller loop 1 as the 15 in number.

Figure 1:
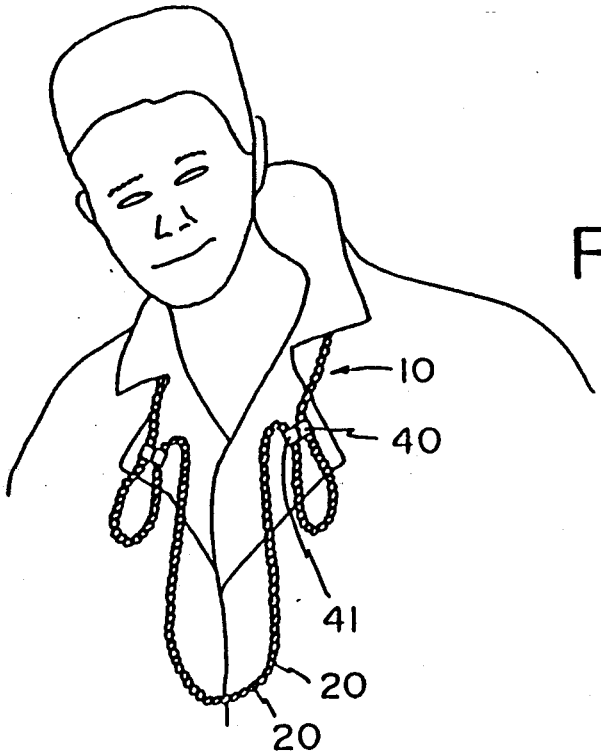
FIG. 1 is a perspective of the necklace according to the invention on a wearer, showing one configuration thereof.
Figure 2:
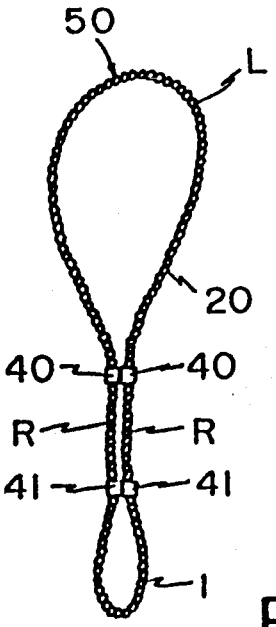
FIG. 2 is a perspective of an alternative configuration.

Referring to FIGS. 1 and 2, the necklace may be configured as shown.

The actual number of bead elements 20 in either of the loops L or l or in each run R need not be identical to that disclosed. The number and position of the magnetizable elements 40 and, also their location may be changed at the will of the end user when assembly of the magnetized novelty bead necklace is done by the end user since I prefer to sell it as a kit.

Figure 3:
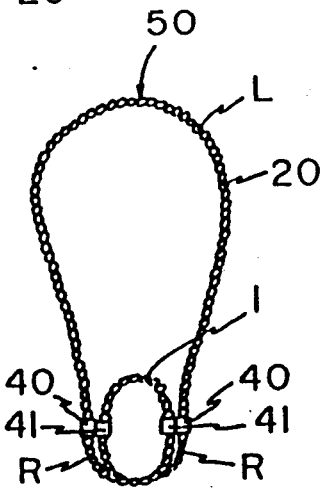
FIG. 3 is a yet a further example of an alternative configuration.
Figure 5:
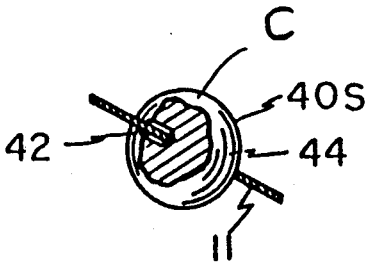
FIG. 5 is a cross-sectional view of alternative form of magnetized elements.

An alternative embodiment of the magnetizable 40S which is spherical rather than cylindrical, and having an aperture 42 therethrough through which the string 11 may pass. In this embodiment, there is an outer coating 44 which may be plastic with or without some pigmentation to provide colouring or other esthetic appeal. The shape of the bead 40 may be cylindrical, as shown in FIGS. 1, 2 and 3, a hexahedron having a channel therethrough as in FIG. 4, or spherical with a channel therethrough, as seen in FIG. 5. Whatever the shape, which provides an esthetically different necklace when various shaped beads are used, they may be covered with an outer pigment cover C, as seen in FIG. 5, and this cover, when it is plastic, may be coloured different colours to provide an esthetic pleasing appearance. It is not necessary that only the magnetized or magnetizable elements 40 have this colour as any of the beads may be pigmented.

I claim:

1. As a necklace, a plurality of spacially disposed discrete elements carried by a flexible strand formed as a continuous loop, wherein at least two of the discrete elements thereof are magnetized and disposed at a predetermined distance, relative to one another, whereby when the magnetized elements are juxtaposed, they constrain the endless flexible loop into sub-loops of unique pre-determined length.

2. The necklace as claimed in claim 1, wherein the magnetized elements have an outer pigmented coating.

3. The necklace as claimed in claim 2, wherein each of the elements defines a channel therethrough through which the strand passes.

4. The necklace as claimed in claim 3, wherein the shape of the elements is selected from the group of hedrons comprising hexahedron, spherical and, cylindrical.

5. The necklace as claimed in claim 1, wherein there are at least four magnetized elements disposed at predetermined distances relative one another.

* * * * *